US011519355B2

(12) United States Patent
Sugimoto

(10) Patent No.: US 11,519,355 B2
(45) Date of Patent: Dec. 6, 2022

(54) MISFIRE DETECTION DEVICE FOR INTERNAL COMBUSTION ENGINE, MISFIRE DETECTION METHOD FOR INTERNAL COMBUSTION ENGINE, AND MEMORY MEDIUM

(71) Applicant: TOYOTA JIDOSHA KABUSHIKI KAISHA, Aichi-ken (JP)

(72) Inventor: Hitoki Sugimoto, Toyota (JP)

(73) Assignee: TOYOTA JIDOSHA KABUSHIKI KAISHA, Aichi-Ken (JP)

( * ) Notice: Subject to any disclaimer, the term of this patent is extended or adjusted under 35 U.S.C. 154(b) by 0 days.

(21) Appl. No.: 17/580,641

(22) Filed: Jan. 21, 2022

(65) Prior Publication Data

US 2022/0243678 A1 Aug. 4, 2022

(30) Foreign Application Priority Data

Jan. 29, 2021 (JP) ..... JP2021-012556

(51) Int. Cl.
*F02D 41/14* (2006.01)
*F02D 41/00* (2006.01)

(52) U.S. Cl.
CPC ..... *F02D 41/1498* (2013.01); *F02D 41/0087* (2013.01); *F02D 2200/101* (2013.01); *F02D 2200/1015* (2013.01)

(58) Field of Classification Search
CPC .. F02D 13/06; F02D 17/02; F02D 2200/1002; F02D 2200/1004; F02D 2200/101; F02D 2200/1012; F02D 2200/1015; F02D 41/008; F02D 41/0087; F02D 41/009; F02D 41/0097;
(Continued)

(56) References Cited

U.S. PATENT DOCUMENTS 5,086,741 A * 2/1992 Nakamura ..... G01M 15/11 123/436
5,275,037 A * 1/1994 Nakayama ..... G01M 15/11 73/114.03
(Continued)

FOREIGN PATENT DOCUMENTS

JP 2009138663 A 6/2009
JP 202253818 A 4/2022
KR 101494544 B1 * 2/2015

*Primary Examiner* — John M Zaleskas
(74) *Attorney, Agent, or Firm* — Hauptman Ham, LLP

(57) ABSTRACT

A misfire detection device and method for an internal combustion engine are provided. A deactivating process deactivates combustion control for air-fuel mixture in a deactivated cylinder. An instantaneous speed variable indicates a speed in a case where a crankshaft rotates by a specific angle. The specific angle of the first instantaneous speed variable is a first angle. The specific angle of the second instantaneous speed variable is a second angle greater than the first angle. A second determining process determines whether a misfire has occurred from a magnitude of a rotation fluctuation amount of a subject of determination, instead of a relative magnitude of the rotation fluctuation amount of the subject of the determination relative to a reference rotation fluctuation amount, when the reference rotation fluctuation amount is a rotation fluctuation amount of the deactivated cylinder during the execution of the deactivating process.

5 Claims, 6 Drawing Sheets

(58) Field of Classification Search
CPC ..... F02D 41/1498; F02D 41/22; F02D 2041/0012; G01M 15/11
See application file for complete search history.

(56) References Cited

U.S. PATENT DOCUMENTS 5,503,007 A * 4/1996 Plee ..... G01M 15/11 73/114.05
5,602,331 A * 2/1997 Prevost ..... G01M 15/11 701/50
5,709,192 A * 1/1998 Zimmermann ..... G01M 15/046 123/436
5,728,941 A * 3/1998 Yamamoto ..... G01M 15/11 123/436
5,832,404 A * 11/1998 Amano ..... G01M 15/11 123/436
6,023,651 A * 2/2000 Nakayama ..... F02D 41/1498 123/436
6,135,089 A * 10/2000 Shibagaki ..... F02D 41/1486 123/480
6,199,426 B1 * 3/2001 Shibagaki ..... G01M 15/11 73/114.04
6,336,440 B1 * 1/2002 Schmitz ..... G01M 15/11 123/406.27
2002/0016666 A1 * 2/2002 Maegawa ..... G01M 15/11 123/406.24
2003/0094037 A1 * 5/2003 Galtier ..... G01M 15/11 73/114.07
2003/0225504 A1 * 12/2003 Katayama ..... G01M 15/11 123/406.13
2006/0288768 A1 * 12/2006 Aono ..... F02D 41/1498 73/114.38
2007/0261484 A1 * 11/2007 Nishigaki ..... G01M 15/11 73/114.04
2008/0148835 A1 * 6/2008 Akimoto ..... B60W 30/20 73/116.01
2008/0196485 A1 * 8/2008 Akimoto ..... G01M 15/046 73/114.02
2009/0049895 A1 * 2/2009 Huber ..... G01M 15/11 73/114.02
2009/0063024 A1 * 3/2009 Katayama ..... G01M 15/11 73/114.02
2009/0088956 A1 * 4/2009 Lin ..... B60Q 9/00 701/111
2009/0107224 A1 * 4/2009 Katayama ..... G01M 15/11 73/114.04
2009/0118990 A1 * 5/2009 Suzuki ..... F02D 29/02 701/111
2009/0145210 A1 * 6/2009 Suzuki ..... G01M 15/11 73/114.04
2009/0151469 A1 * 6/2009 Suzuki ..... B60W 10/06 903/902
2009/0158829 A1 * 6/2009 Suzuki ..... F02D 41/0097 73/114.25
2009/0308145 A1 * 12/2009 Suzuki ..... F02D 41/2451 180/65.28
2009/0326787 A1 * 12/2009 Hofmeister ..... F02D 41/0085 701/104
2010/0030455 A1 * 2/2010 Akimoto ..... B60L 50/61 701/111
2010/0114460 A1 * 5/2010 Akimoto ..... F02D 29/06 73/114.26
2010/0218598 A1 * 9/2010 Suzuki ..... G01M 15/11 73/114.04
2010/0288035 A1 * 11/2010 Arakawa ..... G01M 15/11 73/114.03
2010/0294027 A1 * 11/2010 Kondo ..... G01M 15/11 73/114.02
2012/0016568 A1 * 1/2012 Okazaki ..... G01M 15/11 701/102
2014/0261309 A1 * 9/2014 Chen ..... F02D 17/00 123/320
2016/0109330 A1 * 4/2016 Chen ..... F02D 41/0087 73/114.06
2016/0152231 A1 * 6/2016 Sugimoto ..... B60W 50/0205 903/905
2016/0333764 A1 * 11/2016 Sugimoto ..... F02D 41/2406
2016/0334305 A1 * 11/2016 Hyodo ..... G01M 15/11
2017/0058820 A1 * 3/2017 Sugimoto ..... F02D 41/221
2017/0167952 A1 * 6/2017 Hiroi ..... F02D 41/28
2017/0370804 A1 * 12/2017 Chen ..... G01M 15/11
2018/0246011 A1 * 8/2018 Katayama ..... G01M 15/11
2018/0275017 A1 * 9/2018 Katayama ..... F02D 41/1498
2019/0178191 A1 * 6/2019 Hagari ..... F02D 35/024
2019/0234323 A1 * 8/2019 Weber ..... F01L 13/0036
2020/0309053 A1 * 10/2020 Anzawa ..... F02D 41/068
2020/0309055 A1 * 10/2020 Anzawa ..... F02D 41/009
2021/0404406 A1 * 12/2021 Hotta ..... B62M 7/02
2022/0099037 A1 * 3/2022 Sugimoto ..... F02D 41/2429
2022/0099041 A1 * 3/2022 Anzawa ..... F02D 41/029
2022/0099528 A1 * 3/2022 Sugimoto ..... G01M 15/11
2022/0099529 A1 * 3/2022 Anzawa ..... G01M 15/11
2022/0112853 A1 * 4/2022 Sugimoto ..... F02D 37/02
2022/0120231 A1 * 4/2022 Sugimoto ..... G01M 15/11
2022/0145817 A1 * 5/2022 Sugimoto ..... F02D 41/029
2022/0146375 A1 * 5/2022 Katayama ..... F02D 41/1498
2022/0154660 A1 * 5/2022 Katayama ..... F02D 41/22
2022/0195955 A1 * 6/2022 Sugimoto ..... F02D 41/123

* cited by examiner (a)

(b)

MISFIRE DETECTION DEVICE FOR INTERNAL COMBUSTION ENGINE, MISFIRE DETECTION METHOD FOR INTERNAL COMBUSTION ENGINE, AND MEMORY MEDIUM

RELATED APPLICATIONS

The present application claims priority of Japanese Application Number 2021-012556 filed on Jan. 29, 2021, the disclosure of which is hereby incorporated by reference herein in its entirety.

BACKGROUND

1. Field

The present disclosure relates to a misfire detection device for an internal combustion engine, a misfire detection method for an internal combustion engine, and a memory medium.

2. Description of Related Art

Japanese Laid-Open Patent Publication No. 2009-138663 discloses an example of a misfire detection device that uses a rotation fluctuation amount to determine whether a misfire has occurred. The rotation fluctuation amount is the fluctuation amount of an instantaneous rotation speed. The instantaneous rotation speed is the rotation speed of a crankshaft in an interval that is shorter than the occurrence interval of a compression top dead center. More specifically, whether a misfire has occurred is determined from the difference between a threshold value and the difference between rotation fluctuation amounts that are separated from each other by 360° crank angle (CA). That is, the threshold value is not directly compared with a rotation fluctuation amount of a subject of the determination and is instead compared with a value obtained by subtracting, from the rotation fluctuation amount of the subject of the determination, a rotation fluctuation amount obtained at a point that precedes the present crank angle by 360° CA. This limits the effects caused by manufacturing variations in crank angle sensors and the like (refer to paragraph in the document).

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

Aspects of the present disclosure will now be described.

Aspect 1: An aspect of the present disclosure provides a misfire detection device for an internal combustion engine. The misfire detection device is employed in the internal combustion engine including cylinders. The misfire detection device is configured to execute: a deactivating process that deactivates combustion control for air-fuel mixture in a deactivated cylinder serving as one or more of the cylinders; a fluctuation amount calculating process that calculates a rotation fluctuation amount of a crankshaft from a crank signal; and a determining process that determines whether a misfire has occurred from a magnitude of the rotation fluctuation amount of a subject of a determination of whether a misfire has occurred. The rotation fluctuation amount is a change amount of an instantaneous speed variable. The instantaneous speed variable indicates a speed in a case in which the crankshaft rotates by a specific angle. The fluctuation amount calculating process includes a process that calculates, as the rotation fluctuation amount, a first rotation fluctuation amount and a second rotation fluctuation amount. The first rotation fluctuation amount is a change amount of a first instantaneous speed variable and the second rotation fluctuation amount is a change amount of a second instantaneous speed variable. The specific angle of the first instantaneous speed variable is a first angle. The specific angle of the second instantaneous speed variable is a second angle. The second angle is greater than the first angle. The determining process includes a first determining process that determines whether a misfire has occurred from a relative magnitude of the rotation fluctuation amount of the subject of the determination relative to a reference rotation fluctuation amount and a second determining process that determines whether a misfire has occurred from a magnitude of the rotation fluctuation amount of the subject of the determination, instead of the relative magnitude of the rotation fluctuation amount of the subject of the determination relative to the reference rotation fluctuation amount, when the reference rotation fluctuation amount is the rotation fluctuation amount of the deactivated cylinder during the execution of the deactivating process. The reference rotation fluctuation amount and the rotation fluctuation amount of the subject of the determination are separated from each other by a preset interval. The preset interval is an angular interval of an integral multiple of a single rotation of the crankshaft. The first determining process includes a process that determines whether a misfire has occurred using the first rotation fluctuation amount as the rotation fluctuation amount. The second determining process includes a process that determines whether a misfire has occurred using the second rotation fluctuation amount as the rotation fluctuation amount.

The first determining process compares the determination value with the relative magnitude of the rotation fluctuation amount of the subject of the determination and the reference rotation fluctuation amount, instead of directly comparing the determination value with the magnitude of the rotation fluctuation amount of the subject of the determination. The reference rotation fluctuation amount and the rotation fluctuation amount of the subject of the determination are separated from each other by an integral multiple of a single rotation of the crankshaft. Thus, the same detected portion of the crank rotor is used to calculate these two rotation fluctuation amounts. Accordingly, the tolerance affects the two rotation fluctuation amounts in the same manner Therefore, the influence of the tolerance on the relative magnitude of the rotation fluctuation amount of the subject of the determination and the reference rotation fluctuation amount is sufficiently limited. Consequently, the first determining process determines whether a misfire has occurred while limiting the influence of the tolerance.

However, in the case of executing the deactivating process for the deactivated cylinder, the rotation fluctuation amount of the cylinder of the subject of the deactivation of the combustion control (i.e., deactivated cylinder) is equivalent to the rotation fluctuation amount obtained during a misfire. Thus, when, for example, the rotation fluctuation amount of the cylinder of the subject of the deactivation of the combustion control (i.e., deactivated cylinder) is used as the reference rotation fluctuation amount, it is difficult to accurately determine whether a misfire has occurred from the above-described relative magnitude.

In the above-described configuration, when the reference rotation fluctuation amount is the rotation fluctuation amount of the cylinder of the subject of the deactivation of the combustion control (i.e., deactivated cylinder), the second determining process is executed to determine whether a misfire has occurred from the magnitude of the rotation fluctuation amount of the subject of the determination, not from the relative magnitude. Additionally, an input of the second determining process is used as the second rotation fluctuation amount. The second rotation fluctuation amount is a change amount of the second instantaneous speed variable. The specific angle of the second instantaneous speed variable is greater than the specific angle of the first instantaneous speed variable. The error in the interval between two detected portions of the crank rotor is almost equal to the error in the interval between two detected portions adjacent to each other. The error in the second instantaneous speed variable caused by the tolerance is smaller than the error in the first instantaneous speed variable caused by the tolerance. This limits the influence of the tolerance on the rotation fluctuation amount of the subject of the determination.

Accordingly, the above-described configuration allows for calculation of whether a misfire has occurred with high accuracy even when the deactivating process is executed.

The inventors examined executing a regenerating process for an aftertreatment device when the shaft torque of the internal combustion engine is not zero. More specifically, the inventors examined supplying unburned fuel and oxygen into exhaust gas by executing the regenerating process, that is, by deactivating combustion control only in the deactivated cylinder (one or more cylinders) and increasing the air-fuel ratio of the remaining cylinders to be richer than the stoichiometric air-fuel ratio. However, in this case, an erroneous misfire determination is made if the rotation fluctuation amount at the previous 360° CA is calculated from the instantaneous rotation speed corresponding to the deactivated cylinder. In the above-described configuration, such an erroneous determination is prevented.

Aspect 2: In the misfire detection device according to Aspect 1, the second angle has a magnitude of an occurrence interval of a compression top dead center.

When a misfire occurs in the determined cylinder (a cylinder of the subject of the determination of whether a misfire has occurred), the rotation speed of the crankshaft tends to continue to decrease over a period of the occurrence interval between compression top dead centers. Thus, on the condition that the specific angle is less than or equal to the occurrence interval of a compression top dead center, the absolute value of the rotation fluctuation amount easily increases as the specific angle used to define the instantaneous speed variable increases. Accordingly, in the above-described configuration, the second angle is used as the magnitude of the occurrence interval of a compression top dead center. Thus, as compared with when, for example, the interval of the second angle is further decreased, the rotation fluctuation amount in a case where a misfire has occurred in the determined cylinder is increased.

Aspect 3: In the misfire detection device according to Aspect 2, the first determining process determines whether a misfire has occurred using the first rotation fluctuation amount as the rotation fluctuation amount when a rotation speed of the crankshaft is less than or equal to a high-speed determination value. Further, the first determining process determines whether a misfire has occurred using the second rotation fluctuation amount as the rotation fluctuation amount when the rotation speed of the crankshaft is greater than the high-speed determination value. The second determining process includes a process that determines whether a misfire has occurred using the second rotation fluctuation amount as the rotation fluctuation amount when the rotation speed of the crankshaft is less than or equal to the high-speed determination value.

In a case where the deactivating process has not been executed and no misfire has occurred, the torque of the crankshaft fluctuates such that the occurrence interval between compression top dead centers is a cycle of the fluctuation. The rotation fluctuation resulting from the torque fluctuation is larger when the rotation speed is low than when the rotation speed is high. Thus, in a case where the rotation fluctuation amount is defined using two instantaneous speed variables in the instantaneous speed variable of a compression top dead center, the absolute value of the rotation fluctuation amount is larger when the rotation speed is low than when the rotation speed is high. This increases the difference between the rotation fluctuation amount in a case where a misfire has occurred and the rotation fluctuation amount in a case where no misfire has occurred. Thus, the S/N ratio (the ratio of signal to noise) is increased in the determination of whether a misfire has occurred.

When, for example, the specific angle is set to the occurrence interval of a compression top dead center, the rotation fluctuation amount in a case where no misfire has occurred is approximately zero. Thus, as compared with the above-described case, the difference is small between the rotation fluctuation amount in a case where a misfire has occurred and the rotation fluctuation amount in a case where no misfire has occurred. Accordingly, when the rotation speed of the crankshaft is low, defining the rotation fluctuation amount using two instantaneous speed variables in the occurrence interval of a compression top dead center increases the S/N ratio in the determination of whether a misfire has occurred.

The magnitude of the rotation fluctuation amount quantified using two instantaneous speed variables in the occurrence interval of a compression top dead center is smaller when the rotation speed is high than when the rotation speed is low. That is, the S/N ratio decreases. When a misfire occurs in the determined cylinder, the rotation speed of the crankshaft tends to continue to decrease over a period of the occurrence interval between compression top dead centers. Thus, maximizing the second angle is advantageous in increasing the difference between the rotation fluctuation amount in a case where a misfire has occurred and the rotation fluctuation amount in a case where no misfire has occurred.

In the above-described configuration, the second rotation fluctuation amount is used only when the rotation speed is high and the second determining process is employed.

Aspect 4: A misfire detection method for an internal combustion engine that executes various processes according to any one of the above-described aspects is provided.

Aspect 5: A non-transitory computer-readable memory medium that stores a program that causes a processor to execute the various processes according to any one of the above-described aspects is provided.

Other features and aspects will be apparent from the following detailed description, the drawings, and the claims.

BRIEF DESCRIPTION OF THE DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

This description provides a comprehensive understanding of the methods, apparatuses, and/or systems described. Modifications and equivalents of the methods, apparatuses, and/or systems described are apparent to one of ordinary skill in the art. Sequences of operations are exemplary, and may be changed as apparent to one of ordinary skill in the art, with the exception of operations necessarily occurring in a certain order. Descriptions of functions and constructions that are well known to one of ordinary skill in the art may be omitted.

Exemplary embodiments may have different forms, and are not limited to the examples described. However, the examples described are thorough and complete, and convey the full scope of the disclosure to one of ordinary skill in the art.

An embodiment will now be described with reference to FIGS. 1 to 7.

Figure 1:
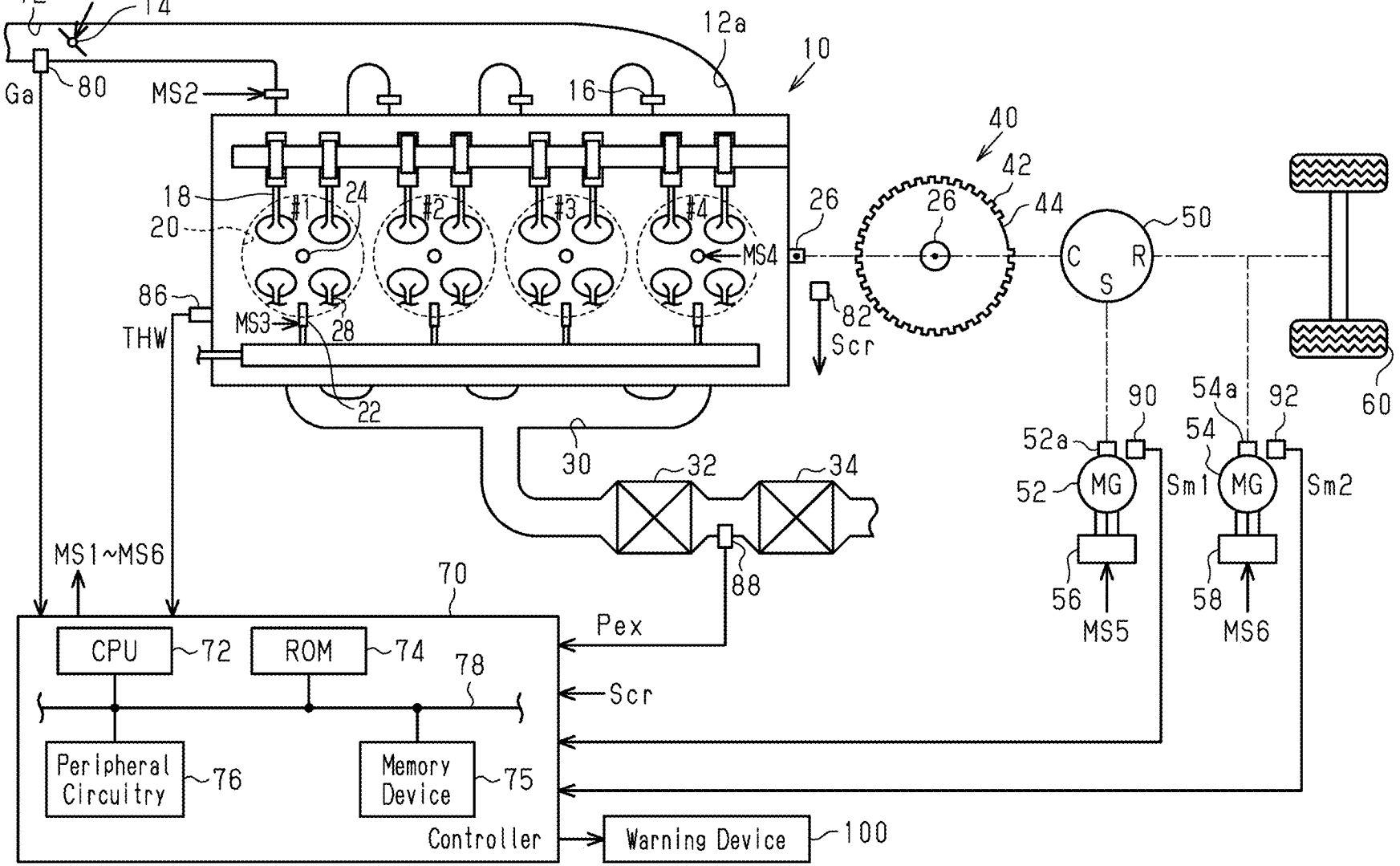
FIG. 1 is a diagram showing the configuration of a drive system and a controller for a vehicle according to an embodiment.

As shown in FIG. 1, an internal combustion engine 10 includes four cylinders #1 to #4. In the internal combustion engine 10, the compression top dead center occurs in the order of cylinder #1, cylinder #3, cylinder #4, and cylinder #2. The internal combustion engine 10 includes an intake passage 12 provided with a throttle valve 14. An intake port 12*a* at a downstream portion of the intake passage 12 includes port injection valves 16. Each of the port injection valves 16 injects fuel into the intake port 12*a*. The air drawn into the intake passage 12 and the fuel injected from the port injection valves 16 flow into combustion chambers 20 as intake valves 18 open. Fuel is injected into the combustion chambers 20 from direct injection valves 22. The air-fuel mixtures of air and fuel in the combustion chambers 20 are burned by spark discharge of ignition plugs 24. The generated combustion energy is converted into rotation energy of a crankshaft 26.

When exhaust valves 28 open, the air-fuel mixtures burned in the combustion chambers 20 are discharged to an exhaust passage 30 as exhaust gas. The exhaust passage 30 includes a three-way catalyst 32 having an oxygen storage capacity and a gasoline particulate filter (GPF) 34. In the GPF 34 of the present embodiment, it is assumed that a three-way catalyst is supported by a filter that traps particulate matter (PM).

A crank rotor 40 with teeth 42 is coupled to the crankshaft 26. The teeth 42 each indicate a corresponding one of the rotation angles of the crankshaft 26. The crank rotor 40 generally includes each tooth 42 at an interval of 10° CA. The crank rotor 40 includes an untoothed portion 44. In the untoothed portion 44, the interval between adjacent ones of the teeth 42 is 30° CA. The untoothed portion 44 indicates the reference rotation angle of the crankshaft 26.

The crankshaft 26 is mechanically coupled to a carrier C of a planetary gear mechanism 50, which includes a power split device. A rotary shaft 52*a* of a first motor generator 52 is mechanically coupled to a sun gear S of the planetary gear mechanism 50. Further, a rotary shaft 54*a* of a second motor generator 54 and driven wheels 60 are mechanically coupled to a ring gear R of the planetary gear mechanism 50. An inverter 56 applies alternating-current voltage to a terminal of the first motor generator 52. An inverter 58 applies alternating-current voltage to a terminal of the second motor generator 54.

The internal combustion engine 10 is controlled by a controller 70. In order to control the controlled variables of the internal combustion engine 10 (for example, torque or exhaust component ratio), the controller 70 operates operation units of the internal combustion engine 10 such as the throttle valve 14, the port injection valves 16, the direct injection valves 22, and the ignition plug 24. The controller 70 controls the first motor generator 52, and operates the inverter 56 in order to control a rotation speed serving as a controlled variable of the first motor generator 52. The controller 70 controls the second motor generator 54, and operates the inverter 58 in order to control torque serving as a controlled variable of the second motor generator 54. FIG. 1 shows operation signals MS1 to MS6 that correspond to the throttle valve 14, the port injection valves 16, the direct injection valves 22, the ignition plugs 24, the inverter 56, and the inverter 58, respectively. To control the controlled variables, the controller 70 refers to an intake air amount Ga detected by an air flow meter 80 and an output signal Scr of a crank angle sensor 82. The output signal Scr is a cycle signal having a cycle in which the crank angle sensor 82 opposes each of the teeth 42 (detected portions). The controller 70 refers to a water temperature THW detected by a water temperature sensor 86 and a pressure Pex of exhaust gas that flows into the GPF 34. The pressure Pex is detected by an exhaust pressure sensor 88. In order to control the controlled variables of the first motor generator 52, the controller 70 refers to an output signal Sm1 of a first rotation angle sensor 90. The output signal Sm1 is used to detect the rotation angle of the first motor generator 52. In order to control the controlled variables of the second motor generator 54, the controller 70 refers to an output signal Sm2 of a second rotation angle sensor 92. The output signal Sm2 is used to detect the rotation angle of the second motor generator 54.

The controller 70 includes a CPU 72, a ROM 74, a memory device 75, and peripheral circuitry 76. These components are capable of communicating with one another via a communication line 78. The peripheral circuitry 76 includes a circuit that generates a clock signal regulating internal operations, a power supply circuit, and a reset circuit. The controller 70 controls the controlled variables by causing the CPU 72 to execute programs stored in the ROM 74. In particular, the controller 70 executes a regenerating process for the GPF 34 and a determining process for a misfire. In the following description, the process related to the regeneration of the GPF 34, the process related to the calculation of the rotation fluctuation amount for determining a misfire, and the process related to a misfire determination will be described in this order.

Process Related to Regeneration of GPF 34

Figure 2:
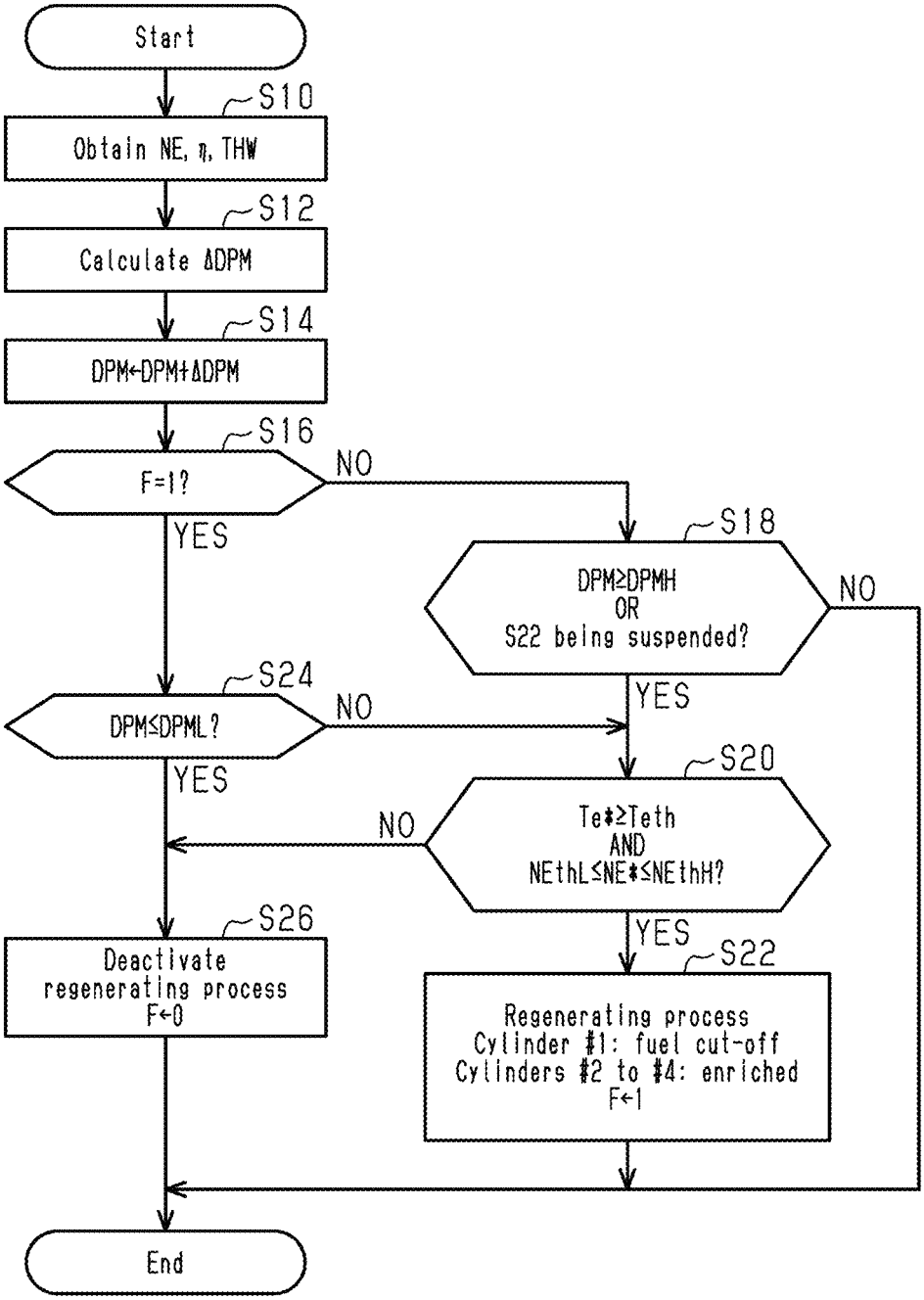
FIG. 2 is a flowchart showing a procedure of the GPF regenerating process according to the embodiment of FIG. 1.

FIG. 2 shows a procedure of processes executed by the controller 70 of the present embodiment. The processes shown in FIG. 2 are executed by the CPU 72 repeatedly executing programs stored in the ROM 74, for example, in a specific cycle. In the following description, the number of each step is represented by the letter S followed by a numeral.

In the series of processes shown in FIG. 2, the CPU 72 first obtains an engine speed NE, a charging efficiency η, and the water temperature THW (S10). The rotation speed NE is calculated by the CPU 72 in reference to the output signal Scr. The charging efficiency η is calculated by the CPU 72 in reference to the intake air amount Ga and the rotation speed NE. Next, the CPU 72 uses the rotation speed NE, the charging efficiency and the water temperature THW to calculate an update amount ΔDPM of a deposition amount DPM (S12). The deposition amount DPM is the amount of PM trapped by the GPF 34. More specifically, the CPU 72 uses the rotation speed NE, the charging efficiency η, and the water temperature THW to calculate the amount of PM in the exhaust gas discharged to the exhaust passage 30. Further, the CPU 72 uses the rotation speed NE and the charging efficiency η to calculate the temperature of the GPF 34. The CPU 72 uses the amount of PM in exhaust gas and the temperature of the GPF 34 to calculate the update amount ΔDPM. When executing the process of S22 (described later), the CPU 72 simply needs to correct the update amount ΔDPM such that the update amount ΔDPM decreases.

Then, the CPU 72 updates the deposition amount DPM in correspondence with the update amount ΔDPM (S14). Subsequently, the CPU 72 determines whether a flag F is 1 (S16). When the flag F is 1, the flag F indicates that the regenerating process is being executed to burn and remove the PM in the GPF 34. When the flag F is 0, the flag F indicates that the regenerating process is not being executed. When determining that the flag F is 0 (S16: NO), the CPU 72 determines whether the logical disjunction is true of a condition in which the deposition amount DPM is greater than or equal to a regeneration execution value DPMH and a condition in which the process of S22 (described later) is being suspended (S18). The regeneration execution value DPMH is set to a value in which PM needs to be removed from the GPF 34 because the amount of PM trapped by the GPF 34 is large. When determining that the logical disjunction of S18 is true (S18: YES), the CPU 72 determines whether the logical conjunction of the following conditions (a) and (b) is true (S20). The process of S20 determines whether the execution of the regenerating process is permitted.

Condition (a): An engine requested torque Te* for the internal combustion engine 10 is greater than or equal to a given value Teth.

Condition (b): The rotation speed NE is greater than or equal to a regeneration lower limit value NEthL and less than or equal to a regeneration upper limit value NEthH.

When determining that the logical conjunction of the following conditions (a) and (b) is true (S20: YES), the CPU 72 executes the regenerating process and substitutes 1 to the flag F (S22). In other words, the CPU 72 deactivates the injection of fuel from the port injection valve 16 and the direct injection valve 22 of cylinder #1. Further, the CPU 72 operates the port injection valve 16 and the direct injection valve 22 such that the air-fuel ratio of the air-fuel mixture in the combustion chambers 20 of cylinders #2 to #4 becomes richer than the stoichiometric air-fuel ratio. The regenerating process of S22 causes oxygen and unburned fuel to be discharged to the exhaust passage 30 so as to increase the temperature of the GPF 34, thereby burning and removing the PM trapped by the GPF 34. That is, the regenerating process causes oxygen and unburned fuel to be discharged to the exhaust passage 30 so as to burn the unburned fuel and thus increase the temperature of exhaust gas in the three-way catalyst 32 and the like. Consequently, the temperature of the GPF 34 is increased. Additionally, the supplying of oxygen into the GPF 34 allows the PM trapped by the GPF 34 to be burned and removed.

When determining that the flag F is 1 (S16: YES), the CPU 72 determines whether the deposition amount DPM is less than or equal to a deactivation threshold value DPML (S24). The deactivation threshold value DPML is set to a value in which the regenerating process is allowed to be deactivated because the amount of PM trapped by the GPF 34 is sufficiently small. When determining that the deposition amount DPM is greater than the deactivation threshold value DPML (S24: NO), the CPU 72 proceeds to the process of S20. When determining that the deposition amount DPM is less than or equal to the deactivation threshold value DPML (S24: YES) or making a negative determination in the process of S20, the CPU 72 deactivates the regenerating process and substitutes 0 into the flag F (S26).

When completing the process of S22, S26 or when making a negative determination in the process of S18, the CPU 72 temporarily ends the series of processes shown in FIG. 2.

Figure 3:
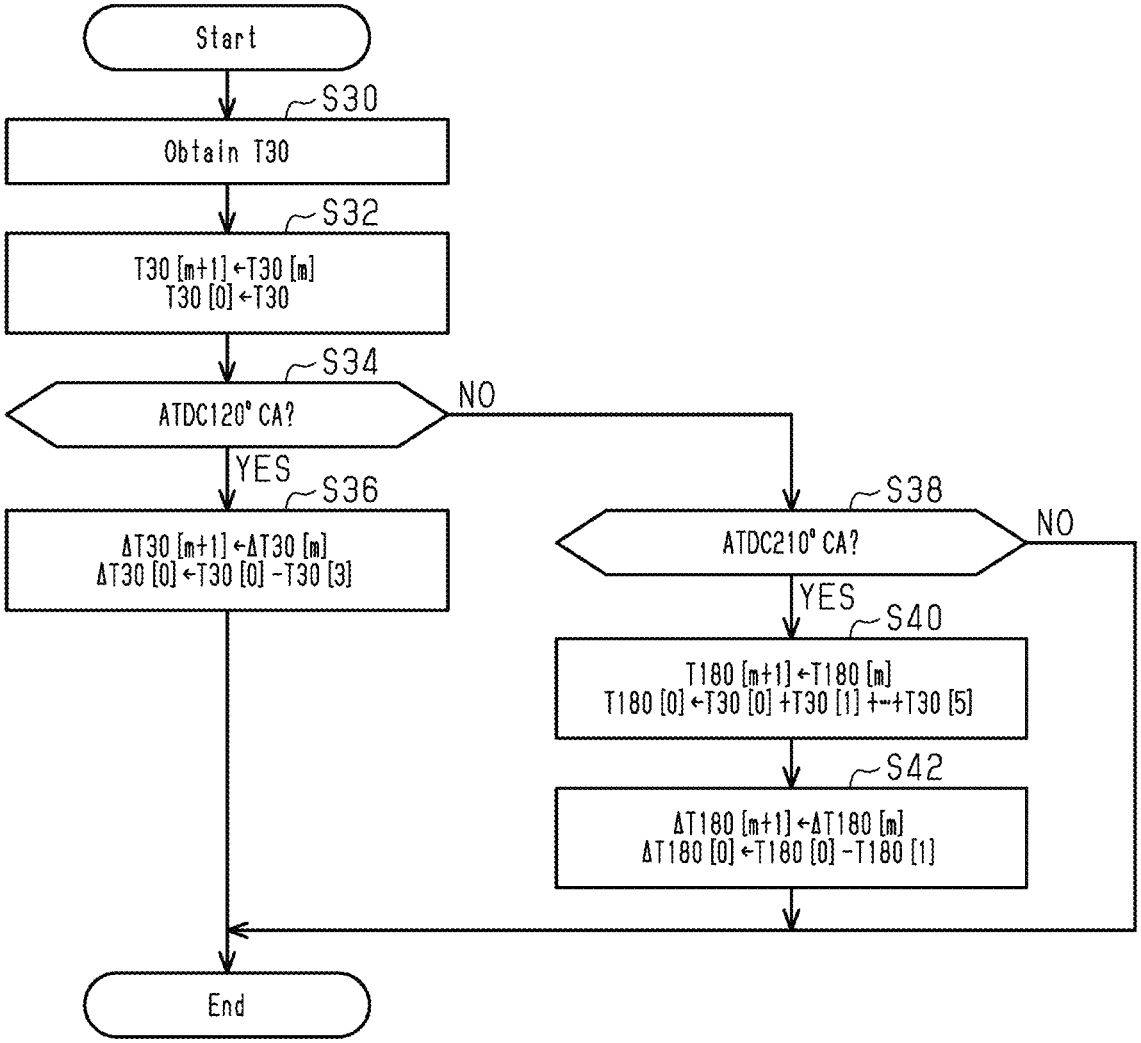
FIG. 3 is a flowchart showing a procedure of processes related to the calculation of the rotation fluctuation amount according to the embodiment of FIG. 1.

Process Related to Calculation of Rotation Fluctuation Amount for Misfire Determination FIG. 3 shows a procedure of a fluctuation amount calculating process (processes related to the calculation of the rotation fluctuation amount of the crankshaft). The processes shown in FIG. 3 are executed by the CPU 72 repeatedly executing programs stored in the ROM 74, for example, in a specific cycle.

In the series of processes shown in FIG. 3, the CPU 72 first obtains a first time T30 (S30). During the first time T30, the crankshaft 26 rotates by 30° CA. The CPU 72 uses the output signal Scr to calculate the first time T30 by executing a process that counts the time for the tooth 42 opposing the crank angle sensor 82 to be switched to a tooth 42 separated from that tooth 42 by 30° CA. Next, the CPU 72 substitutes the first time T30[m] into the first time T30[m+1], where m=0, 1, 2, 3, . . . , and substitutes, into the first time T30[0], the new first time T30 obtained in the process of S30 (S32). This process is executed such that the variable in the square bracket subsequent to the first time T30 becomes larger the further back in time it represents. In this process, when the value of the variable in the square bracket is increased by one, the first time T30 is counted at the previous first 30° CA.

Subsequently, the CPU 72 determines whether the current rotation angle of the crankshaft 26 is ATDC120° CA with reference to the compression top dead center of one of cylinders #1 to #4 (S34). ATDC stands for after top dead center. When determining that the current rotation angle of the crankshaft 26 is ATDC120° CA (S34: YES), the CPU 72 substitutes a first rotation fluctuation amount ΔT30[m] into a first rotation fluctuation amount ΔT30[m+1] and substitutes, into a first rotation fluctuation amount ΔT30[0], a value obtained by subtracting the first time T30[3] from the first time T30[0] (S36). The first rotation fluctuation amount ΔT30 is a variable that becomes a negative value when no misfire occurs in a determined cylinder (a cylinder of the subject of the determination of whether a misfire occurs) and becomes a positive value when a misfire occurs in the determined cylinder. This determined cylinder refers to a cylinder of which the compression top dead center is determined as having passed by 120° through the process of S34.

When determining that the current rotation angle of the crankshaft 26 is not ATDC120° CA (S34: NO), the CPU 72 determines whether the current rotation angle of the crankshaft 26 is ATDC210° CA (S38). When determining that the current rotation angle of the crankshaft 26 is ATDC210° CA (S38: YES), the CPU 72 substitutes a second time T180[m] into a second time T180[m+1] and calculates a second time T180[0] (S40). During the second time T180, the crankshaft 26 rotates by 180° CA from ATDC30° CA to ATDC210° CA. The CPU 72 substitutes, into the second time T180[0], the sum of recent six first times T30[0] to T30[5]. Then, the CPU 72 substitutes a second rotation fluctuation amount ΔT180[m] into a second rotation fluctuation amount ΔT180 [m+1] and substitutes, into a second rotation fluctuation amount ΔT180[0], a value obtained by subtracting the second time T180[1] from the second time T180[0] (S42). The second rotation fluctuation amount ΔT180 is a variable that is approximately zero when no misfire occurs in a determined cylinder and is a positive value when a misfire occurs in the determined cylinder. This determined cylinder refers to a cylinder of which the compression top dead center is determined as having passed by 210° through the process of S38.

When completing the process of S36, S42, or when making a negative determination in the process of S38, the CPU 72 temporarily ends the series of processes shown in FIG. 3.

Process Related to Determination of Misfire

Figure 4:
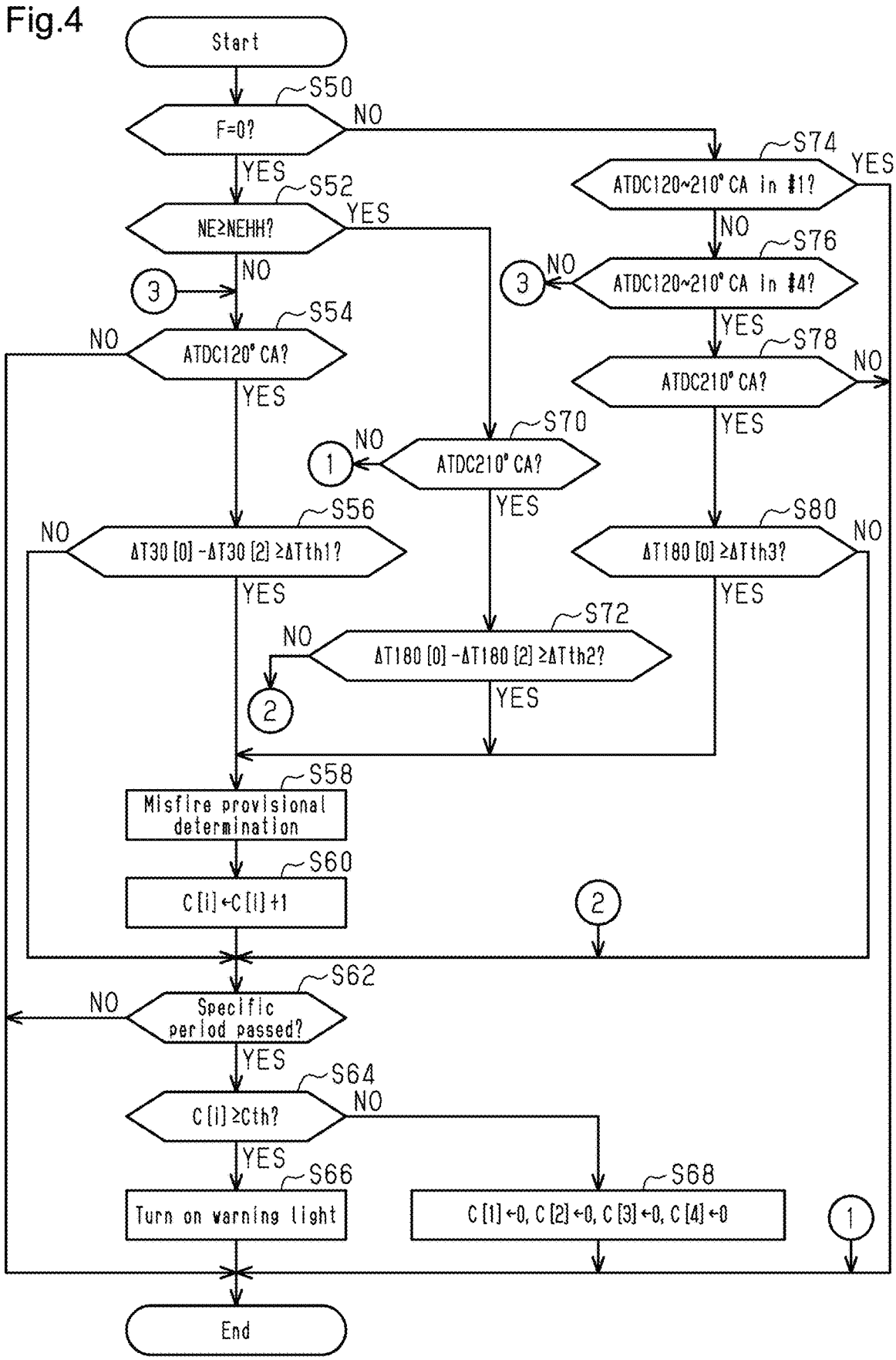
FIG. 4 is a flowchart showing a procedure of processes related to the determination of a continuous cylinder misfire according to the embodiment of FIG. 1.

FIG. 4 shows a procedure of processes related to determining a misfire. The processes shown in FIG. 4 are executed by the CPU 72 repeatedly executing programs stored in the ROM 74, for example, in a specific cycle.

In the series of processes shown in FIG. 4, the CPU 72 first determines whether the flag F is 0 (S50). When determining that the flag F is 0 (S50: YES), the CPU 72 determines whether the rotation speed NE is greater than or equal to a high-speed determination value NEHH (S52). The high-speed determination value NEHH is greater than the regeneration upper limit value NEthH. When determining that the rotation speed NE is less than the high-speed determination value NEHH (S52: NO), the CPU 72 determines whether the current rotation angle of the crankshaft 26 is ATDC120° CA of any one of cylinders #1 to #4 (S54).

When determining that the current rotation angle of the crankshaft 26 is ATDC120° CA of any one of cylinders #1 to #4 (S54: YES), the CPU 72 determines whether the value obtained by subtracting the first rotation fluctuation amount ΔT30[2] from the first rotation fluctuation amount ΔT30[0] is greater than or equal to a first determination value ΔTth1 (S56). The process of S56 determines whether a misfire has occurred in a determined cylinder (a cylinder of the subject of determining whether a misfire has occurred). This determined cylinder refers to a cylinder of which the compression top dead center is determined as having passed by 120° in the process of S54. More specifically, the CPU 72 sets the first determination value ΔTth1 to be larger when the rotation speed NE is low than when the rotation speed NE is high. This process is based on increases in the rotation fluctuation of the crankshaft 26 that occur as the rotation speed NE decreases. Further, the CPU 72 sets the first determination value ΔTth1 to be larger when the charging efficiency 11 is high than when the charging efficiency η is low. This process is based on increases in the rotation fluctuation of the crankshaft 26 that occur as the charging efficiency η increases.

When determining that the value obtained by subtracting the first rotation fluctuation amount ΔT30[2] from the first rotation fluctuation amount ΔT30[0] is greater than or equal to the first determination value ΔTth1 (S56: YES), the CPU 72 makes a provisional determination that a misfire has occurred in a determined cylinder #i (S58). Then, the CPU 72 increments a counter C[i] that counts the number of provisional determinations of misfire for the determined cylinder #i (S60). Subsequently, the CPU 72 determines whether a specific period has elapsed since the point in time at which the process of S68 (described later) was executed (S62).

When determining that the specific period has elapsed (S62: YES), the CPU 72 determines whether the counters C[1] to C[4] include a counter that is greater than or equal to a threshold value Cth (S64). That is, when at least one of the counters C[1] to C[4] is greater than or equal to the threshold value Cth, the determination result of S64 is YES. When determining the counters C[1] to C[4] include a counter that is greater than or equal to the threshold value Cth (S64: YES), the CPU 72 operates a warning light 100, which is shown in FIG. 1, to issue a notification indicating that an official determination has been made (S66). The official determination indicates that a misfire has occurred. The official determination of S64 is that the misfire ratio in a specific cylinder is greater than an allowable range. When determining that the counters C[1] to C[4] are all less than the threshold value Cth (S64: NO), the CPU 72 initializes the counters C[1] to C[4] (S68).

When determining that the rotation speed NE is greater than or equal to the high-speed determination value NEHH (S52: YES), the CPU 72 determines whether the current rotation angle of the crankshaft 26 is ATDC210° CA of any one of cylinders #1 to #4 (S70). When determining that the current rotation angle of the crankshaft 26 is ATDC210° CA (S70: YES), the CPU 72 determines whether the value obtained by subtracting the second rotation fluctuation amount ΔT180[2] from the second rotation fluctuation amount ΔT180[0] is greater than or equal to a second determination value ΔTth2 (S72). This process determines whether a misfire has occurred in a determined cylinder. This determined cylinder refers to a cylinder of which the compression top dead center is determined as having passed by 210° in the process of S70. More specifically, the CPU 72 sets the second determination value ΔTth2 to be larger when the rotation speed NE is low than when the rotation speed NE is high. Further, the CPU 72 sets the second determination value ΔTth2 to be larger when the charging efficiency η is high than when the charging efficiency η is low. The second determination value ΔTth2 is variably set for the same reason as when the first determination value ΔTth1 is variably set in S56.

When determining that the value obtained by subtracting the second rotation fluctuation amount ΔT180[2] from the second rotation fluctuation amount ΔT180[0] is greater than or equal to the second determination value ΔTth2 (S72: YES), the CPU 72 proceeds to the process of S58. When determining that the value obtained by subtracting the second rotation fluctuation amount ΔT180[2] from the second rotation fluctuation amount ΔT180[0] is less than the second determination value ΔTth2 (S72: NO), the CPU 72 proceeds to the process of S62.

When determining that the flag F is 1 (S50: NO), the CPU 72 determines whether the current rotation angle of the crankshaft 26 is ATDC120 to 210° CA of cylinder #1 (S74). When determining that the current rotation angle of the crankshaft 26 is not ATDC120 to 210° CA of cylinder #1 (S74: NO), the CPU 72 determines whether the current rotation angle of the crankshaft 26 is ATDC120 to 210° CA of cylinder #4 (S76). When determining that the current rotation angle of the crankshaft 26 is not ATDC120 to 210° CA of cylinder #4 (S76: NO), the CPU 72 proceeds to the process of S54. When determining that the current rotation angle of the crankshaft 26 is ATDC120 to 210° CA of cylinder #4 (S76: YES), the CPU 72 determines whether the current rotation angle of the crankshaft 26 is ATDC210° CA (S78). When determining that the current rotation angle of the crankshaft 26 is ATDC210° CA (S78: YES), the CPU 72 determines whether the second rotation fluctuation amount ΔT180[0] is greater than or equal to a third determination value ΔTth3 (S80). The process of S80 determines whether a misfire has occurred in the determined cylinder #4. More specifically, the CPU 72 sets the third determination value ΔTth3 to be larger when the rotation speed NE is low than when the rotation speed NE is high. Further, the CPU 72 sets the third determination value ΔTth3 to be larger when the charging efficiency η is high than when the charging efficiency η is low. The third determination value ΔTth3 is variably set for the same reason as when the first determination value ΔTth1 is variably set in S56.

When determining that the second rotation fluctuation amount ΔT180[0] is greater than or equal to the third determination value ΔTth3 (S80: YES), the CPU 72 proceeds to the process of S58. When determining that the second rotation fluctuation amount ΔT180[0] is less than the third determination value ΔTth3 (S80: NO), the CPU 72 proceeds to the process of S62.

When completing the process of S66, S68, when making a negative determination in the process of S54, S62, S70, S78, or when making an affirmative determination in the process of S74, the CPU 72 temporarily ends the series of processes shown in FIG. 4.

The operation and advantages of the present embodiment will now be described.

When determining that the value obtained by subtracting the reference first rotation fluctuation amount ΔT30[2] from the first rotation fluctuation amount ΔT30[0] of the determined cylinder is greater than or equal to the first determination value ΔTth1 (S56: YES), the CPU 72 makes the provisional determination that a misfire has occurred in the determined cylinder (S58). The reference first rotation fluctuation amount ΔT30[2] is separated from the first rotation fluctuation amount ΔT30 of the subject of the determination by 360° CA. The first rotation fluctuation amounts ΔT30[0] and ΔT30[2] are calculated by detecting the same tooth 42. Thus, the error in the first rotation fluctuation amount ΔT30[0] that results from the tolerance of the tooth 42 is equal to the error in the first rotation fluctuation amount ΔT30[2] that results from the tolerance of the tooth 42. Accordingly, the amount obtained by subtracting the first rotation fluctuation amount ΔT30[2] from the first rotation fluctuation amount ΔT30[0] is an amount in which the influence of the error resulting from the tolerance of the tooth 42 is limited in a favorable manner. This increases the misfire determination accuracy.

For the determined cylinder, the determination of a misfire by limiting the influence of the tolerance is based on the fact that the reference first rotation fluctuation amount ΔT30 is the first rotation fluctuation amount ΔT30 of a cylinder in which combustion has been performed normally.

When the amount of PM trapped by the GPF 34 becomes large (S24: NO), the CPU 72 executes the regenerating process (S22). That is, in the regenerating process (S22), the CPU 72 executes the deactivating process that deactivates the combustion control for cylinder #1 and an enriching combustion process that enriches the air-fuel ratio of air-fuel mixture in cylinders #2 to #4.

During the execution of the regenerating process, when cylinder #4 is the determined cylinder for a misfire (S78: YES), the CPU 72 determines whether a misfire has occurred by comparing the second rotation fluctuation amount ΔT180 with the third determination value ΔTth3 (S80). That is, the compression top dead center of cylinder #1 occurs prior to the compression top dead center of cylinder #4 by 360° CA. During the regenerating process, the first rotation fluctuation amount ΔT30 of cylinder #1 is equivalent to an amount obtained when a misfire occurs. Thus, when the CPU 72 determines whether a misfire has occurred in cylinder #4, the misfire determination accuracy decreases in the case of using, for example, the value obtained by subtracting the first rotation fluctuation amount ΔT30[2] that is prior to the first rotation fluctuation amount ΔT30[0] of cylinder #4 by 360° CA.

In particular, the CPU 72 uses the second rotation fluctuation amount ΔT180, instead of the first rotation fluctuation amount ΔT30, as the rotation fluctuation amount used to determine whether a misfire has occurred in cylinder #4. This limits the influence of tolerance as described below.

Figure 5:
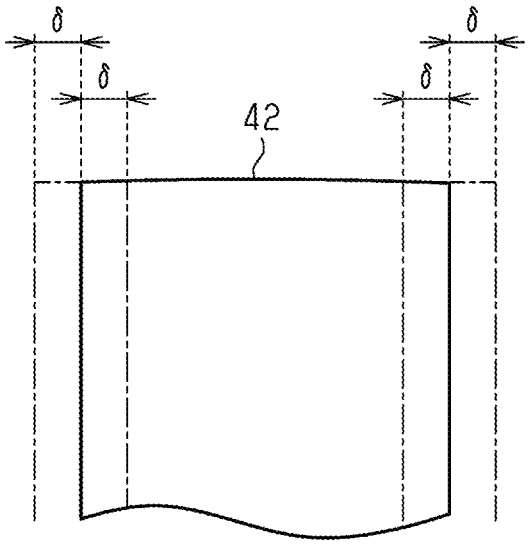
FIG. 5 is a diagram showing tolerances of the crank rotor according to the embodiment of FIG. 1.

As shown in FIG. 5, the tolerance of the tooth 42 may affect the positions of opposite ends of the tooth 42 so as to shift by an error δ at the maximum in the circumferential direction of the crank rotor 40. In other words, the tolerance affects the tooth 42 (shown by the alternate long and short dashed line on the outer side in FIG. 5), having a larger width than the tooth 42 with median characteristics (shown by the solid line in FIG. 5) by 2·δ, so as to have the maximum width. Further, the tolerance affects the tooth 42 (shown by the alternate long and short dashed line on the inner side in FIG. 5), having a smaller width than the tooth 42 with median characteristics (shown by the solid line in FIG. 5) by 2·δ, so as to have the minimum width. That is, the difference between the maximum value and minimum value of the width of the tooth 42 affected by the tolerance is 4·δ.

Figure 6:
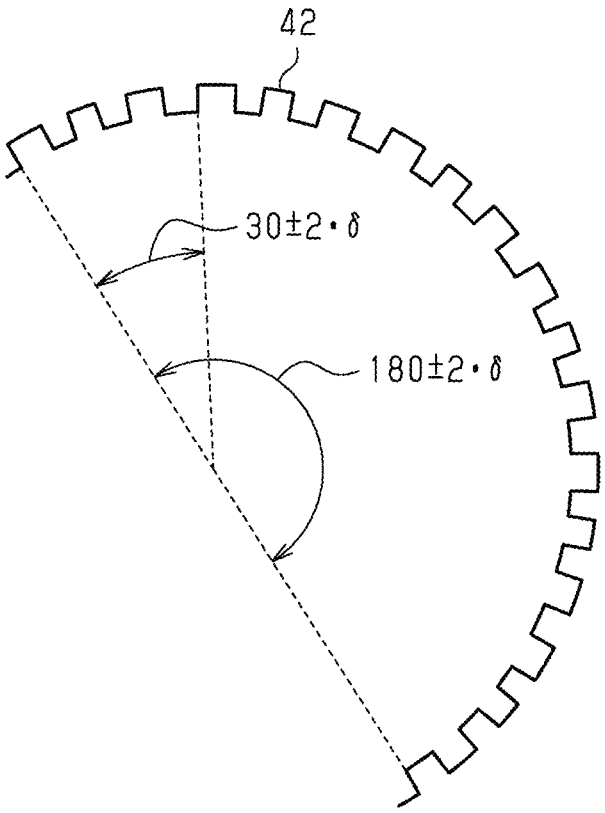
FIG. 6 is a diagram showing tolerances of the crank rotor according to the embodiment of FIG. 1.

FIG. 6 illustrates part of the crank rotor 40 having a tolerance. As shown in FIG. 6, due to the tolerance of the teeth 42 each arranged at 10° CA, the angle between one end and the other end of opposite ones of the three teeth 42 is between 30-2. &CA and 30+2. &CA inclusive. The angle between one end and the other end of opposite ones of the eighteen teeth 42 is between 180-2. &CA and 180+2. &CA inclusive. That is, in either case, the magnitude of the error resulting from the tolerance is less than or equal to 2. &CA.

Thus, since 2·δ/180° CA is smaller than 2·δ/30° CA, the second time T180 represents the rotation speed of the crankshaft 26 more accurately than the first time T30. In other words, the second time T180 has a smaller error that results from the tolerance of the tooth 42 than the first time T30. Accordingly, using the second rotation fluctuation amount ΔT180 to determine whether a misfire has occurred in cylinder #4 makes the tolerance less affected than using, for example, the first rotation fluctuation amount ΔT30.

More specifically, during normal operation in which the combustion control for cylinder #1 is not deactivated (S50: YES), the CPU 72 generally executes the process of S56 to determine whether a misfire has occurred. The process of S56 is executed to determine whether the value obtained by subtracting, from the first rotation fluctuation amount ΔT30

[0], the first rotation fluctuation amount ΔT30[2] at the previous first 360° CA is greater than or equal to the first determination value ΔTth1. When the combustion control for cylinder #1 is deactivated (S50: NO), the CPU 72 executes the process of S80 to determine whether a misfire has occurred in cylinder #4, of which the compression top dead center is separated from the compression top dead center of cylinder #1 by 360° CA. The process of S80 is executed to determine whether the second rotation fluctuation amount ΔT180[0] is greater than or equal to the third determination value ΔTth3. The angular interval that defines the second rotation fluctuation amount ΔT180 is greater than the angular interval that defines the first rotation fluctuation amount ΔT30. Therefore, even in the case of executing the deactivating process for combustion control in a deactivated cylinder (one or more of the cylinders), the misfire detection device for the internal combustion engine is capable of determining whether a misfire has occurred highly accurately.

The above-described present embodiment further provides the following operation and advantages.

(1) When determining that the rotation speed NE is less than the high-speed determination value NEHH (S52: NO), the CPU 72 generally uses the first rotation fluctuation amount ΔT30 to determine whether a misfire has occurred (S56). When determining that the rotation speed NE is greater than or equal to the high-speed determination value NEHH (S52: YES), the CPU 72 uses the second rotation fluctuation amount ΔT180 to determine whether a misfire has occurred (S72). This maximizes the signal-to-noise ratio (S/N ratio) in determining whether a misfire has occurred.

Figure 7:
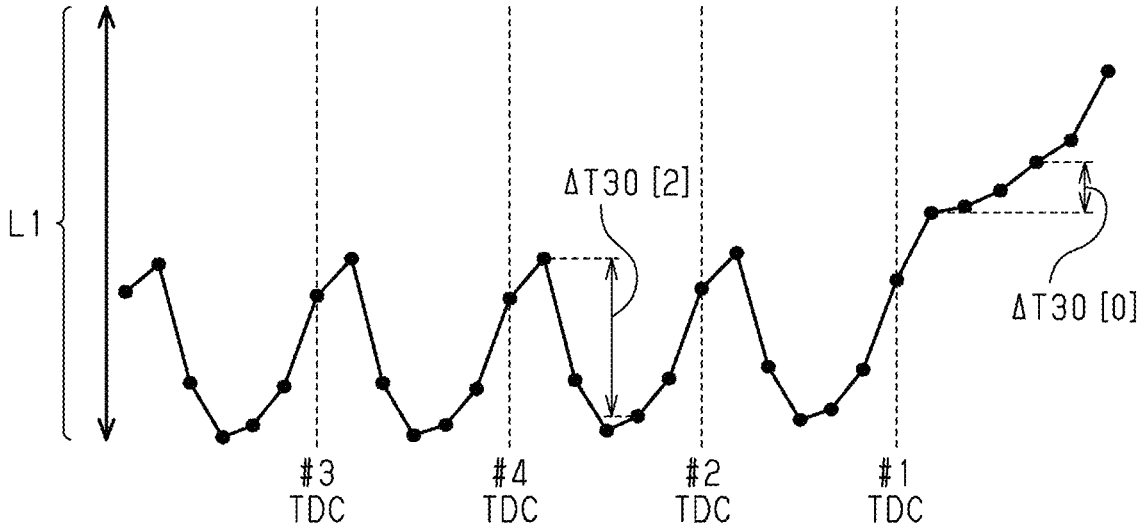
FIG. 7 is a timing diagram showing the rotation behavior of the crankshaft according to the embodiment of FIG. 1, including section (a) and section (b).
Figure 7:
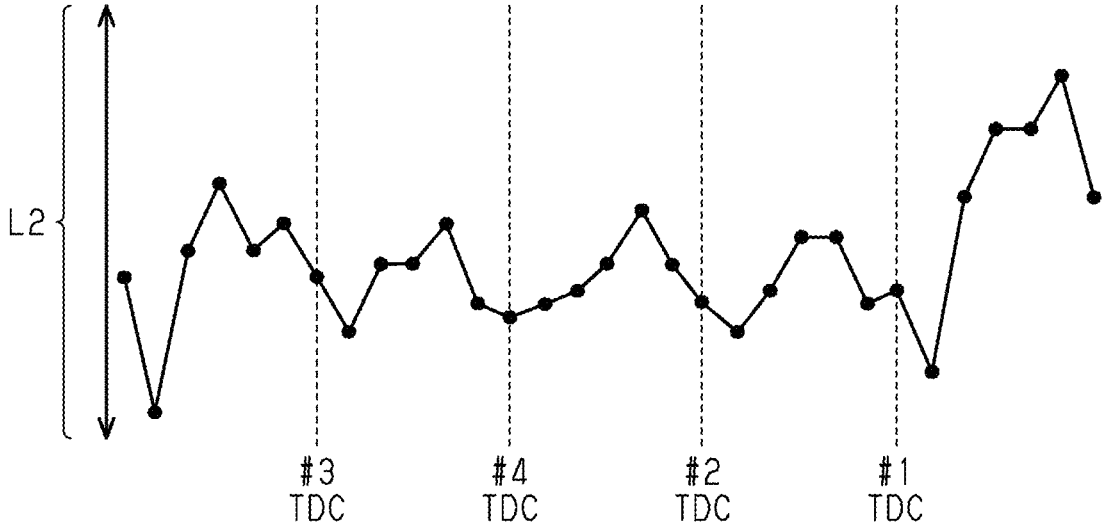

In FIG. 7, section (a) illustrates changes in the first time T30 in the case where the rotation speed NE is less than the high-speed determination value NEHH (S52: NO). As shown in section (a) of FIG. 7, the first time T30 fluctuates to a large extent in a cycle of the occurrence interval of the compression top dead center (TDC). Thus, the absolute value of the first rotation fluctuation amount ΔT30 is large when no misfire occurs. Accordingly, the value obtained by subtracting the reference first rotation fluctuation amount ΔT30[2] from the first rotation fluctuation amount ΔT30[0] of the subject of the determination is also large when a misfire occurs in the determined cylinder.

In FIG. 7, section (b) illustrates changes in the first time T30 in the case where the rotation speed NE is greater than or equal to the high-speed determination value NEHH (S52: YES). Length L2 in the vertical axis shown in section (b) of FIG. 7 is a few tenths of length L1 in the vertical axis shown in section (a) of FIG. 7. As shown in FIG. 7, when the rotation speed NE increases, the first time T30 fluctuates to a small extent. Accordingly, when a misfire occurs in the determined cylinder, the value obtained by subtracting the reference first rotation fluctuation amount ΔT30[2] from the first rotation fluctuation amount ΔT30[0] of the subject of the determination in section (b) of FIG. 7 is smaller than the value in section (a) of FIG. 7.

Thus, when determining that the rotation speed NE is greater than or equal to the high-speed determination value NEHH (S52: YES), the CPU 72 uses the second rotation fluctuation amount ΔT180 (S72). When a misfire occurs, the rotation speed of the crankshaft 26 tends to continue to decrease over the period of 180° CA. Accordingly, the difference between a case where a misfire occurs and a case where a misfire does not occur is more remarkable in the second rotation fluctuation amount ΔT180 than in the first rotation fluctuation amount ΔT30. Thus, when the rotation speed NE is greater than or equal to the high-speed determination value NEHH, the CPU 72 uses the second rotation fluctuation amount. Therefore, in the case where the rotation speed NE is greater than or equal to the high-speed determination value NEHH, using the second rotation fluctuation amount ΔT180 increases the accuracy of determining whether a misfire has occurred as compared with, for example, using the first rotation fluctuation amount ΔT30.

(2) Even during the regenerating process (S50: NO), the CPU 72 uses the first rotation fluctuation amount ΔT30 to determine whether a misfire has occurred (S56) in cylinders #2 and #3 (S76: NO). When the rotation speed NE is lower than the high-speed determination value NEHH (S52: NO), the difference between a case where a misfire occurs and a case where a misfire does not occur is particularly large in the first rotation fluctuation amount ΔT30 and thus the first rotation fluctuation amount ΔT30 is used. Accordingly, the S/N ratio is increased as compared with when, for example, the second rotation fluctuation amount ΔT180 is used.

Correspondence

The correspondence between the items in the above-described embodiment and the items described in the above-described SUMMARY is as follows. In the following description, the correspondence is shown for each of the numbers in the examples described in the SUMMARY.

[1], [2] The deactivating process corresponds to the process of S22. The determining process corresponds to the processes of S56, S72, S80.

The first instantaneous speed variable corresponds to the first time T30. The second instantaneous speed variable corresponds to the second time T180.

The first rotation fluctuation amount corresponds to the first rotation fluctuation amount ΔT30. The second rotation fluctuation amount corresponds to the second rotation fluctuation amount ΔT180.

The first determining process corresponds to the processes of S56, S72. The second determining process corresponds to the process of S80.

[3] The high-speed determination value corresponds to the high-speed determination value NEHH.

Modifications

The present embodiment may be modified as follows. The above-described embodiment and the following modifications can be combined as long as the combined modifications remain technically consistent with each other.

Modification Related to Instantaneous Speed Variable

In the above-described embodiment, the specific angle (first angle), which is the crank angle interval that defines the first instantaneous speed variable, is 30° CA. Instead, the specific angle (first angle) that defines the first instantaneous speed variable may be, for example, 10° CA.

In the above-described embodiment, the specific angle (second angle), which is the crank angle interval that defines the second instantaneous speed variable, is 180° CA. Instead, the specific angle (second angle) that defines the second instantaneous speed variable may be, for example, an angular interval that is shorter than the occurrence interval of the compression top dead center and longer than the angular interval that defines the first instantaneous speed variable.

The specific angle that defines the instantaneous speed variable in the case where the rotation speed NE is greater than or equal to the high-speed determination value NEHH may be different from the specific angle used for the second determining process.

The instantaneous speed variable is not limited to an amount having the dimension of time and may be, for example, an amount having the dimension of speed.

Modification Related to Rotation Fluctuation Amount

In the above-described embodiment, the rotation fluctuation amount that is normally used when the rotation fluctuation amount is less than the high-speed determination value NEHH (S52: NO) is the difference between instantaneous speed variables that are separated from each other by 120° CA. Instead, for example, the rotation fluctuation amount that is normally used when the rotation fluctuation amount is less than the high-speed determination value NEHH may be the difference between instantaneous speed variables that are separated from each other by 90° CA.

The rotation fluctuation amount is not limited to the difference between the instantaneous speed variables and may be the ratio of the instantaneous speed variables.

Modification Related to Official Determination

In the above-described embodiment, it is determined whether an anomaly in which the misfire ratio of a specific cylinder (for example, an anomaly in which a misfire has occurred in a continuous manner in a specific cylinder) has occurred (S64). Instead, for example, it may be determined whether an anomaly in which the total misfire ratio of the cylinders of the internal combustion engine has occurred.

Modification Related to First Determining Process

In the first determining process (S56, S72), the difference between the rotation fluctuation amounts separated from each other by 360° CA does not have to be used. The difference between the rotation fluctuation amounts separated from each other by 360° CA is ΔT30[0]-ΔT30[2] or ΔT180[0]-ΔT180[2]. For example, the difference between the rotation fluctuation amounts separated from each other by 720° CA may be used for the first determining process. In short, when the difference between rotation fluctuation amounts separated from each other by an integral multiple of 360° CA is used for the first determining process, the accuracy of the provisional determination is prevented from being lowered by the tolerance of the tooth 42 of the crank rotor 40. That is, since 360° CA is the angular interval of a single rotation of the crankshaft 26, an integral multiple of 360° CA is equivalent to the angular interval of an integral multiple of a single rotation of the crankshaft 26. The reference rotation fluctuation amount (ΔT30[2], ΔT180[2]) and the rotation fluctuation amount of the subject of the determination (ΔT30[0], ΔT180[0]) simply need to be separated from each other by a preset interval of an integral multiple of a single rotation of the crankshaft 26. The first determining process simply needs to determine whether a misfire has occurred from the relative magnitude of the rotation fluctuation amount of the subject of the determination (ΔT30[0], ΔT180[0]) relative to the reference rotation fluctuation amount (ΔT30[2], ΔT180[2]).

In S56, the first determination value ΔTth1 does not necessarily have to be variably set using the rotation speed NE and the charging efficiency η. For example, the first determination value ΔTth1 may be variably set using only one of the rotation speed NE and the charging efficiency η or may be variably set using at least one of the rotation speed NE and the charging efficiency η and using the water temperature THW. However, variable setting of the first determination value ΔTth1 is not necessary.

In S72, the second determination value ΔTth2 does not necessarily have to be variably set using the rotation speed NE and the charging efficiency η. For example, the second determination value ΔTth2 may be variably set using only one of the rotation speed NE and the charging efficiency η or may be variably set using at least one of the rotation speed NE and the charging efficiency η and using the water temperature THW. However, variable setting of the second determination value ΔTth2 is not necessary.

When the rotation speed NE is greater than or equal to the high-speed determination value NEHH (S52: YES), the input used for the determination does not necessarily have to be switched from the first rotation fluctuation amount ΔT30 to the second rotation fluctuation amount ΔT180.

Modification Related to Second Determining Process

In S80, the third determination value ΔTth3 does not necessarily have to be variably set using the rotation speed NE and the charging efficiency η. For example, the third determination value ΔTth3 may be variably set using only one of the rotation speed NE and the charging efficiency η or may be variably set using at least one of the rotation speed NE and the charging efficiency η and using the water temperature THW. However, variable setting of the third determination value ΔTth3 is not necessary. That is, the second determining process simply needs to determine whether a misfire has occurred from the magnitude of the rotation fluctuation amount of the subject of the determination (ΔT180[0]), instead of the relative magnitude of the rotation fluctuation amount of the subject of the determination (ΔT180[0]) relative to the reference rotation fluctuation amount (ΔT180[2]), when the reference rotation fluctuation amount (ΔT180[2]) is the rotation fluctuation amount of the deactivated cylinder (#1) (S78: YES) during the execution of the deactivating process (S22) (S50: NO).

Modification Related to Deactivating Process

The deactivating process that deactivates combustion control for air-fuel mixture in the deactivated cylinder (one or more of the cylinders) is not limited to the regenerating process. For example, the deactivating process may deactivate the supply of fuel in one or more of the cylinders in order to adjust the output of the internal combustion engine 10. Instead, in a case where an anomaly has occurred in one or more of the cylinders, the deactivating process may deactivate combustion control in the cylinder. Alternatively, for example, when the oxygen absorption amount of the three-way catalyst 32 is less than or equal to a given value, the deactivating process may deactivate combustion control only in one or more of the cylinders and execute control that sets the air-fuel ratio of air-fuel mixture in the remaining cylinders to the stoichiometric air-fuel ratio.

Modification Related to Crank Rotor

FIGS. 1 and 6 show the example in which the crank rotor 40 includes each tooth 42 at an interval of 10° CA. Instead, the crank rotor 40 simply needs to include each tooth 42 at an interval that is less than or equal to the occurrence interval of a compression top dead center.

The detected portion arranged in each specific angular interval is not limited to each tooth 42. For example, instead of arranging each tooth 42 on the outer circumference of the crank rotor 40, a hole may be provided along the outer circumference of the crank rotor 40 and used as the detected portion. Alternatively, a member that differs from the surroundings of the hole in magnetic permeability may be embedded into the hole.

Modification Related to Aftertreatment Device

In the aftertreatment device, the GPF 34 does not have to be arranged downstream of the three-way catalyst 32. Instead, the three-way catalyst 32 may be arranged downstream of the GPF 34. Alternatively, the aftertreatment device does not necessarily have to include the three-way catalyst 32 and the GPF 34. For example, the aftertreatment device may include only the GPF 34. For example, even when the aftertreatment device includes only the three-way catalyst 32, the processes illustrated in the above-described embodiment and the modifications can be executed during the regeneration process for aftertreatment device in a case where the aftertreatment device needs to be heated. When the GPF is arranged downstream of the three-way catalyst 32 in the aftertreatment device, the GPF is not limited to the filter supported by the three-way catalyst and may include only the filter.

Modification Related to Controller

The controller is not limited to a device that includes the CPU 72 and the ROM 74 and executes software processing. For example, at least part of the processes executed by the software in the above-described embodiment may be executed by hardware circuits dedicated to executing these processes (such as ASIC). That is, the control device may be modified as long as it has any one of the following configurations (a) to (c): (a) a configuration including a processor that executes all of the above-described processes according to programs and a program storage device such as a ROM (including a non-transitory computer readable memory medium) that stores the programs. (b) a configuration including a processor and a program storage device that execute part of the above-described processes according to the programs and a dedicated hardware circuit that executes the remaining processes; and (c) a configuration including a dedicated hardware circuit that executes all of the above-described processes. A plurality of software execution devices each including a processor and a program storage device and a plurality of dedicated hardware circuits may be provided.

Modification Related to Internal Combustion Engine

The number of cylinders in the internal combustion engine is not limited to four and may be, for example, six or eight.

The internal combustion engine does not necessarily have to include the port injection valves 16 and the direct injection valves 22.

The internal combustion engine is not limited to a spark-ignition engine such as a gasoline engine. For example, the internal combustion engine 10 may be a compression ignition internal combustion engine that uses light oil as fuel.

Modification Related to Vehicle

The vehicle is not limited to a series-parallel hybrid vehicle and may be, for example, a parallel hybrid vehicle or a series hybrid vehicle. The hybrid vehicle may be replaced with, for example, a vehicle in which only the internal combustion engine 10 is used as a power generation device for the vehicle.

In this specification, "at least one of A and B" should be understood to mean "only A, only B, or both A and B."

Various changes in form and details may be made to the examples above without departing from the spirit and scope of the claims and their equivalents. The examples are for the sake of description only, and not for purposes of limitation. Descriptions of features in each example are to be considered as being applicable to similar features or aspects in other examples. Suitable results may be achieved if sequences are performed in a different order, and/or if components in a described system, architecture, device, or circuit are combined differently, and/or replaced or supplemented by other components or their equivalents. The scope of the disclosure is not defined by the detailed description, but by the claims and their equivalents. All variations within the scope of the claims and their equivalents are included in the disclosure.

What is claimed is:

1. A misfire detection device for an internal combustion engine, the misfire detection device being employed in the internal combustion engine including cylinders, wherein the misfire detection device is configured to execute:

a deactivating process that deactivates combustion control for air-fuel mixture in a deactivated cylinder serving as one or more of the cylinders;

a fluctuation amount calculating process that calculates a rotation fluctuation amount of a crankshaft based on a crank signal; and a determining process that determines whether a misfire has occurred in one cylinder of the cylinders based on a magnitude of a further rotation fluctuation amount, wherein the further rotation fluctuation amount is defined as the rotation fluctuation amount with respect to said one cylinder, the rotation fluctuation amount is a change amount of an instantaneous speed variable, the instantaneous speed variable indicates a rotation speed of the crankshaft in a case in which the crankshaft rotates by a specific angle, the fluctuation amount calculating process calculates, as the rotation fluctuation amount, a first rotation fluctuation amount and a second rotation fluctuation amount, the first rotation fluctuation amount is a first change amount of a first instantaneous speed variable indicating a first rotation speed of the crankshaft when the crankshaft rotates by a first angle, the second rotation fluctuation amount is a second change amount of a second instantaneous speed variable indicating a second rotation speed of the crankshaft when the crankshaft rotates by a second angle, the second angle being greater than the first angle, the determining process includes a first determining process that determines whether the misfire has occurred based on a relative magnitude of the further rotation fluctuation amount relative to a reference rotation fluctuation amount, and a second determining process that determines whether the misfire has occurred based on the magnitude of the further rotation fluctuation amount, when the reference rotation fluctuation amount is the rotation fluctuation amount of the deactivated cylinder during an execution of the deactivating process, the reference rotation fluctuation amount and the further rotation fluctuation amount are separated from each other by a preset interval, the preset interval is an angular interval of an integral multiple of a single rotation of the crankshaft, the first determining process includes determining whether the misfire has occurred using the first rotation fluctuation amount as the further rotation fluctuation amount, and the second determining process includes determining whether the misfire has occurred using the second rotation fluctuation amount as the further rotation fluctuation amount.

2. The misfire detection device according to claim 1, wherein the second angle has a further magnitude of an occurrence interval of a compression top dead center.

3. The misfire detection device according to claim 2, wherein the first determining process determines whether the misfire has occurred using the first rotation fluctuation amount as the further rotation fluctuation amount when the rotation speed of the crankshaft is less than a high-speed determination value, the first determining process determines whether the misfire has occurred using the second rotation fluctuation amount as the further rotation fluctuation amount when the rotation speed of the crankshaft is greater than or equal to the high-speed determination value, and the second determining process includes determining whether the misfire has occurred using the second rotation fluctuation amount as the further rotation fluctuation amount when the rotation speed of the crankshaft is less than or equal to the high-speed determination value.

4. A misfire detection method for an internal combustion engine, the misfire detection method being employed in the internal combustion engine including cylinders, the misfire detection method comprising:

deactivating combustion control for air-fuel mixture in a deactivated cylinder serving as one or more of the cylinders;

calculating a rotation fluctuation amount of a crankshaft based on a crank signal; and determining whether a misfire has occurred in one cylinder of the cylinders based on a magnitude of a further rotation fluctuation amount, wherein the further rotation fluctuation amount is defined as the rotation fluctuation amount with respect to said one cylinder, wherein the rotation fluctuation amount is a change amount of an instantaneous speed variable, the instantaneous speed variable indicates a rotation speed of the crankshaft in a case in which the crankshaft rotates by a specific angle, the calculating the rotation fluctuation amount includes calculating, as the rotation fluctuation amount, a first rotation fluctuation amount and a second rotation fluctuation amount, the first rotation fluctuation amount is a first change amount of a first instantaneous speed variable indicating a first rotation speed of the crankshaft when the crankshaft rotates by a first angle, the second rotation fluctuation amount is a second change amount of a second instantaneous speed variable indicating a second rotation speed of the crankshaft when the crankshaft rotates by a second angle, the second angle being greater than the first angle, the specific angle of the first instantaneous speed variable is a first angle, the determining whether the misfire has occurred includes determining whether the misfire has occurred based on a relative magnitude of the further rotation fluctuation amount relative to a reference rotation fluctuation amount, and determining whether the misfire has occurred based on the magnitude of the further rotation fluctuation amount, when the reference rotation fluctuation amount is the rotation fluctuation amount of the deactivated cylinder during an execution of the deactivating combustion control for the air-fuel mixture in the deactivated cylinder, the reference rotation fluctuation amount and the further rotation fluctuation amount are separated from each other by a preset interval, the preset interval is an angular interval of an integral multiple of a single rotation of the crankshaft, in determining whether the misfire has occurred based on the relative magnitude, the first rotation fluctuation amount is used as the further rotation fluctuation amount, and in determining whether the misfire has occurred based on the magnitude, the second rotation fluctuation amount is used as the further rotation fluctuation amount.

5. A non-transitory computer-readable memory medium that stores a program for causing a processor to execute a misfire detection process for an internal combustion engine, the misfire detection process being employed in the internal combustion engine including cylinders, wherein the misfire detection process includes:

deactivating combustion control for air-fuel mixture in a deactivated cylinder serving as one or more of the cylinders;

calculating a rotation fluctuation amount of a crankshaft based on a crank signal; and determining whether a misfire has occurred in one cylinder of the cylinders based on a magnitude of a further rotation fluctuation amount, wherein the further rotation fluctuation amount is defined as the rotation fluctuation amount with respect to said one cylinder, wherein the rotation fluctuation amount is a change amount of an instantaneous speed variable, the instantaneous speed variable indicates a rotation speed of the crankshaft in a case in which the crankshaft rotates by a specific angle, the calculating the rotation fluctuation amount includes calculating, as the rotation fluctuation amount, a first rotation fluctuation amount and a second rotation fluctuation amount, the first rotation fluctuation amount is a first change amount of a first instantaneous speed variable indicating a first rotation speed of the crankshaft when the crankshaft rotates by a first angle, the second rotation fluctuation amount is a second change amount of a second instantaneous speed variable indicating a second rotation speed of the crankshaft when the crankshaft rotates by a second angle, the second angle being greater than the first angle, the determining whether the misfire has occurred includes a first determining process that determines whether the misfire has occurred based on a relative magnitude of the further rotation fluctuation amount relative to a reference rotation fluctuation amount, and a second determining process that determines whether the misfire has occurred based on the magnitude of the further rotation fluctuation amount, when the reference rotation fluctuation amount is the rotation fluctuation amount of the deactivated cylinder during an execution of the deactivating combustion control for the air-fuel mixture in the deactivated cylinder, the reference rotation fluctuation amount and the further rotation fluctuation amount are separated from each other by a preset interval, the preset interval is an angular interval of an integral multiple of a single rotation of the crankshaft, the first determining process includes determining whether the misfire has occurred using the first rotation fluctuation amount as the further rotation fluctuation amount, and the second determining process includes determining whether the misfire has occurred using the second rotation fluctuation amount as the further rotation fluctuation amount.

* * * * *